US009863704B2

(12) United States Patent
Vild

(10) Patent No.: US 9,863,704 B2
(45) Date of Patent: Jan. 9, 2018

(54) CHIP DRYER WITH INTEGRATED EXHAUST GAS TREATMENT

(71) Applicant: PYROTEK, INC., Spokane, WA (US)

(72) Inventor: Chris T. Vild, Chagrin Falls, OH (US)

(73) Assignee: PYROTEK, INC., Spokane, WA (US)

( * ) Notice: Subject to any disclaimer, the term of this patent is extended or adjusted under 35 U.S.C. 154(b) by 0 days.

(21) Appl. No.: 15/300,031

(22) PCT Filed: Mar. 31, 2015

(86) PCT No.: PCT/US2015/023466
§ 371 (c)(1),
(2) Date: Sep. 28, 2016

(87) PCT Pub. No.: WO2015/153538
PCT Pub. Date: Oct. 8, 2015

(65) Prior Publication Data

US 2017/0176102 A1 Jun. 22, 2017

Related U.S. Application Data

(60) Provisional application No. 61/972,748, filed on Mar. 31, 2014.

(51) Int. Cl.
*F26B 3/04* (2006.01)
*F26B 25/00* (2006.01)
(Continued)

(52) U.S. Cl.
CPC ..... *F26B 25/006* (2013.01); *F26B 3/04* (2013.01); *F26B 17/20* (2013.01); *F26B 23/001* (2013.01); *F26B 23/02* (2013.01)

(58) Field of Classification Search
CPC ..... F26B 25/006; F26B 3/04; F26B 17/20; F26B 23/001; F26B 23/02; F27D 3/16; F27D 27/00; F16D 1/108
(Continued)

(56) References Cited

U.S. PATENT DOCUMENTS 3,619,907 A * 11/1971 Kallas ..... F26B 11/0481 34/137
4,191,530 A 3/1980 Bearce
(Continued)

FOREIGN PATENT DOCUMENTS

CA 2944343 A1 * 10/2015 ..... F26B 11/14
KR 2000045853 A 7/2000
(Continued)

OTHER PUBLICATIONS

International Search Report PCT/US2015/023466.

*Primary Examiner* — Stephen M Gravini
(74) *Attorney, Agent, or Firm* — Fay Sharpe LLP

(57) ABSTRACT

According to a first embodiment, a dryer for removing hydrocarbons and/or moisture from metal chips is provided. The dryer includes a top portion and a base portion. The top portion comprises an elongated tubular chamber containing a scrap conveyor. The base portion comprises a burner, a heat exchanger, a high temperature VOC elimination chamber and a vent for returning reduced VOC gasses to the top portion. The top portion is configured to receive the metal chips at an inlet and transport the metal chips to an outlet while receiving heated air from the base portion.

21 Claims, 7 Drawing Sheets

(51) Int. Cl.
*F26B 23/00* (2006.01)
*F26B 23/02* (2006.01)
*F26B 17/20* (2006.01)

(58) Field of Classification Search
USPC ..... 34/79; 266/235, 217
See application file for complete search history.

(56) References Cited

U.S. PATENT DOCUMENTS

| | | | | |
|---|---|---|---|---|
| 4,252,300 | A * | 2/1981 | Herder | F23D 23/00 110/212 |
| 4,683,664 | A * | 8/1987 | Codenotti | F26B 3/22 34/126 |
| 4,878,839 | A * | 11/1989 | Wunning | F23G 7/065 110/211 |
| 9,108,244 | B2 * | 8/2015 | Cooper | B22D 41/015 |
| 9,328,615 | B2 * | 5/2016 | Cooper | C21C 1/06 |
| 2014/0041252 | A1 * | 2/2014 | Vild | F26B 21/02 34/500 |
| 2017/0176102 | A1 * | 6/2017 | Vild | F26B 25/006 |

FOREIGN PATENT DOCUMENTS

| | | | |
|---|---|---|---|
| KR | 10-368931 | B1 | 1/2003 |
| KR | 10-58229 | B1 | 8/2011 |

* cited by examiner

CHIP DRYER WITH INTEGRATED EXHAUST GAS TREATMENT

BACKGROUND

The present exemplary embodiment relates to a chip dryer with integrated exhaust gas treatment. It finds particular application in conjunction with a scrap metal submergence device, and will be described with particular reference thereto. However, it is to be appreciated that the present exemplary embodiment is also amenable to other like applications.

This disclosure relates to a method for the treatment of waste products, in particular, waste products of metal which are contaminated with water, oil and oleaginous cooling agents, and to an apparatus for carrying out such method.

When metals are machined, a number of waste products are automatically produced in the form of particles or chips, e.g. fillings, turnings, borings or machining scrap. In the machining of metals, for example, aluminum and aluminum alloys, oil or oil containing cooling fluids may be employed. The machined chips will therefore be contaminated with oil. In a typical situation, the borings and turnings will include, by weight, from 2 to 20 percent cutting oil.

Nonetheless, recovery of the scrap borings, turnings and chips is desirable in view of the cost of the base materials. However, the high moisture and hydrocarbon content in the material creates a dangerous situation of moisture expansion or explosion within the furnace. In addition, the hydrocarbon content will create contamination, melt loss and excessive smoking. Accordingly, direct introduction of the material into a molten metal environment is, for all practical purposes, nearly impossible.

Various attempts have been made in the industry to overcome the foregoing problems by removing the moisture and hydrocarbons from the material. One recovery process used for chips is washing of the chips with a subsequent drying process. The washers will basically dissolve the hydrocarbon leaving the chips somewhat free of the hydrocarbons but still heavy with moisture. The wet material is then dried. The use of solvents to remove the oil from the oil-coated chips works well. However, this is an expensive method and not desirable from an environmental point of view. Alternatively, centrifuge can remove both hydrocarbon content and water to a certain extent. However, this can be a time consuming and expensive process. As a further alternative, thermal dryers have been developed which uses various means of heating the products with hot air. However, to date these systems have been inefficient and not particularly environmental friendly.

The present disclosure provides a description of an improved thermal dryer apparatus to provide scrap pieces having very low hydrocarbon and water content.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

According to a first embodiment, a dryer for removing hydrocarbons and/or moisture from metal chips is provided. The dryer includes a top portion and a base portion. The top portion comprises an elongated tubular chamber containing a scrap conveyor. The base portion comprises a burner, a heat exchanger, a high temperature VOC elimination chamber and a vent for returning heated gas to the top portion. The top portion is configured to receive the metal chips at an inlet and transport the metal chips to an outlet while receiving heated air from the base portion.

According to a second embodiment, a dryer for removing at least one of hydrocarbons and moisture from metal chips is provided. The dryer includes a top portion and a base portion. The top portion comprises an elongated tubular chamber having an inlet end and an outlet end with a screw conveyor extending between the inlet end and the outlet end. The base portion includes an inlet portion receiving exhaust gas from the top portion and a plenum for transporting the exhaust gas to a heater which increases the temperature of the exhaust gas to obtain a super-heated exhaust gas. A heat exchanger is also provided which receives the super-heated exhaust gas and transfers heat to the process gas.

According to a third embodiment, a dryer for removing hydrocarbons and/or moisture from metal chips is provided. The dryer comprises a top portion and a base portion. The top portion includes an elongated tubular chamber containing a scrap conveyor. The base portion includes a burner, a heat exchanger and a high temperature VOC elimination chamber wherein exhaust gas from the top portion is received in the base portion and heated by the burner within the VOC elimination chamber to obtain a super-heated gas. The super-heated gas is introduced to a first side of the heat exchanger with external air being introduced to a second side of the heat exchanger. The device is configured to receive metal chips at an inlet and transport the metal chips to an outlet while receiving heated external air from the heat exchanger of the base portion.

DETAILED DESCRIPTION

Figure 1:
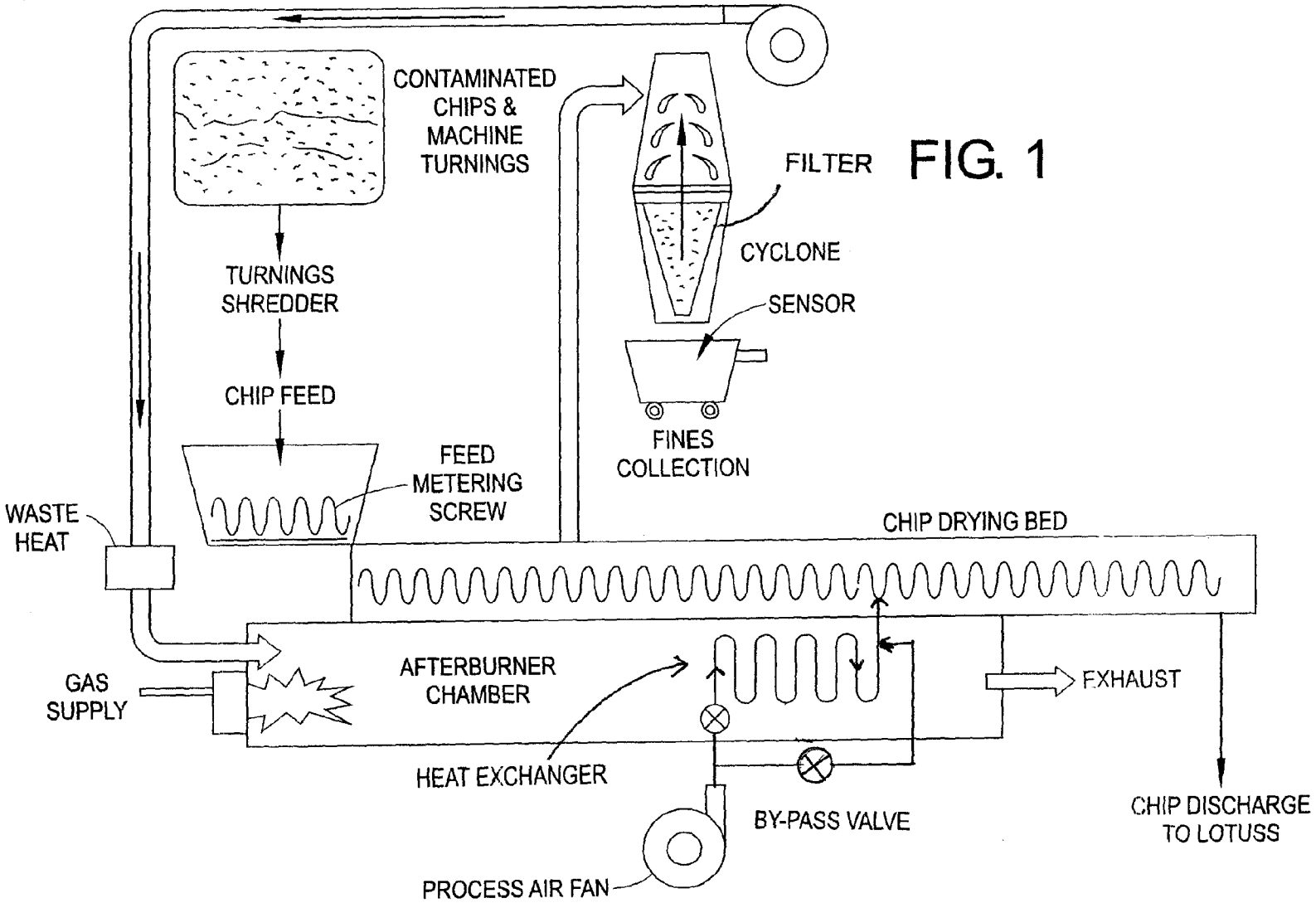
FIG. 1 is a schematic illustration of a representative embodiment of the subject chip dryer.

Referring now to FIG. 1, a schematic description of the present chip dryer is illustrated. Wet chips are metered into the dryer where they are conveyed over hot jets via a screw conveyor. The chips are dried, for example to less than 0.1% residual moisture for delivery to a scrap submergence device such as a LOTUSS (available from Pyrotek Inc. of Spokane, Wash. The exhaust air from the drying process is drawn into the heat exchanger where it is heated to at least about 1400° F. in the oxidizer such that the VOC's are eliminated. This air is then cooled down as it passes across the heat exchanger and then discharged to the atmosphere. Simultaneously, fresh air is passed across the other side of the heat exchanger where it is heated to about 600-800° F. and then blown into the chips in the screw conveyor.

In certain embodiments, it may be advantageous to introduce waste heat obtained from a location in the plant such as the metal melting furnace. Waste heat of for example 500° F. could be introduced just upstream of the introduction of air into the afterburner chamber. In addition, it may be useful to utilize a heat exchanger in the air flow channel between air intake and introduction into the afterburner chamber, the heat exchanger being heated by waste heat. These are efficient means to obtain a preheated air source such that the gas heater requires less fuel to achieve a VOC elimination temperature.

In certain embodiments, it may be advantageous to include a by-pass between the process air fan and the heat exchanger to provide improved temperature control and allow for system turn-down. Moreover, in this manner the temperature and the flow rate of air being delivered to the chip drying bed are possible.

In certain embodiments, a cyclone collector may be employed to collect dust from the treatment air after passing through the chips being dried. The cyclone may rely on inertial collection and/or may also include a filter. Typically a metal filter of pores having a diameter between about 1/32" and 3/4" can be employed. Furthermore, although a cart is depicted in FIG. 1 for fines collection, it is also likely that a drum or other closed container may be employed. In the case of a closed container, it may be advantageous to include a sensor to provide a warning of the container reaching a nearly full state. For example, paddle wheel sensor could be included.

Figure 2:
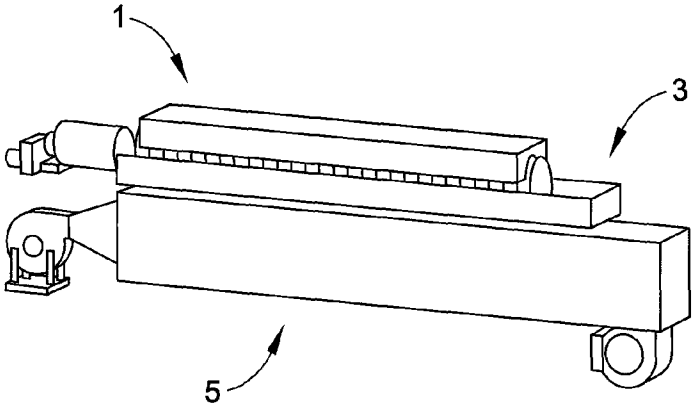
FIG. 2 is a perspective view (partially in phantom) of a first embodiment of the subject chip dryer.

Referring now to FIG. 2, an open loop dryer assembly is depicted. Particularly, dryer assembly 1 includes an upper unit 3 and a lower unit 5. Upper unit 3 constitutes the chip feeder component and lower unit 5 constitutes the heated air supply apparatus.

Figure 3:
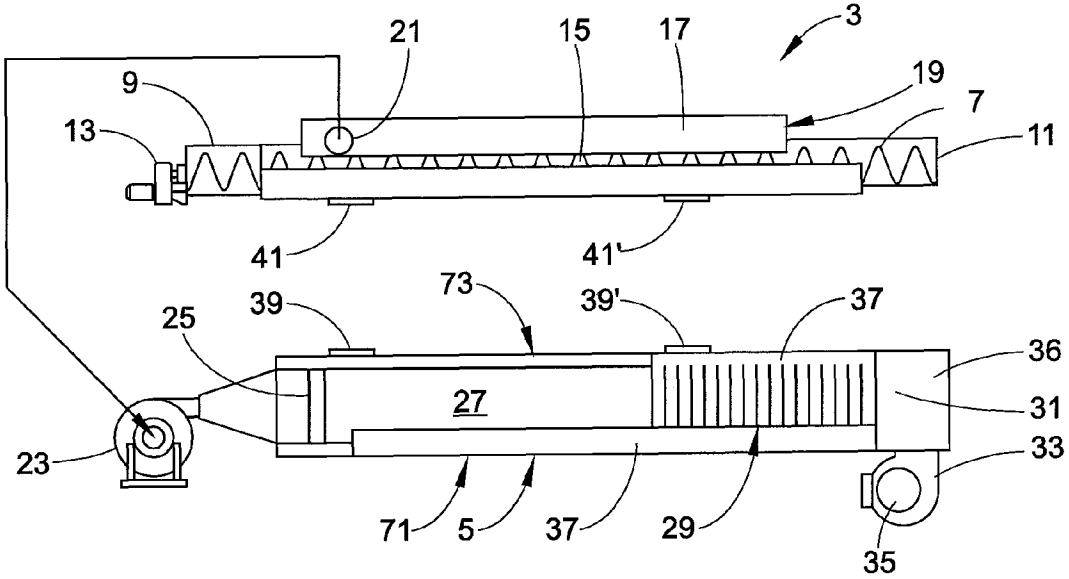
FIG. 3 is an exploded side elevation view, partially in cross section of the chip dryer of FIG. 2.

Referring now to FIG. 3, the dryer assembly is depicted in more detail. Upper unit 3 is comprised of an elongated tube 7, having a first end including scrap inlet 9 and a second end including outlet 11. Motor 13 powers a conveyor screw 15 which transports scrap introduced through inlet 9 to outlet 11. A cap element 17 overlies the elongated tube 7 and provides a head space 19 suitable for the collection of dryer exhaust gasses which are discharged through an outlet 21 and circulated to the lower unit 5.

Lower unit 5 includes a blower 23 which receives exhaust gas from outlet 21. The exhaust gas is forced by the blower 23 through a heater 25 and into a volatile organic component (VOC) removal zone 27. VOCs are eliminated in this zone by heating to approximately 1400° F. or higher. The super-heated gas produced in the VOC removal zone 27 passes into and is cooled in a heat exchanger 29 and exits the lower unit 5 via exhaust duct 31 to the atmosphere.

External air is introduced to the lower unit 5 via inlet 33 and blower 35. The external air is passed through a chamber 36 and introduced into a plenum 37 forming an outer portion of the lower unit 5. Advantageously, the plenum 37 creates a temperature barrier to the external environment. Plenum 37 is in fluid communication with the heat exchanger 29, particularly, a side of the heat exchanger opposed to the side containing the super-heated exhaust gas. In this regard, the external air is circulated through and heated in heat exchanger 29. Plenum 37 includes a pair of outlets 39 and 39' arranged to mate with inlets 41, 41' in the upper unit 3 and provide heated (e.g. 800° F. or higher) external air for chip treatment.

In operation, wet chips are metered into the dryer where they are conveyed through hot air via the screw conveyor. The blower units 23 and 35 may allow the hot air to be introduced into the upper unit 3 at a high velocity, such as in excess of 10%. The chips can be dried to a 0.1% moisture content. The exhaust air from the upper unit is drawn into the lower unit where it is heated to 1400 F or higher, for example, in the oxidizer zone where the VOCs are eliminated. This "clean" air is then cooled down as it passes across the heat exchanger and released to the atmosphere. Simultaneously fresh air sent across the other side of the heat exchanger is heated to 600-800 F then blown into the chips being transported by the screw conveyor.

The dryer assembly 1 is advantageous because chips containing oil or moisture result in melt loss, poor melt quality, higher maintenance costs and potential environmental/health/safety problems. The dryer assembly 1 can be used in combination with a Pyrotek LOTUSS system for optimal energy efficiency and melt recovery for in house chip processing. Particularly, the present dryer assembly can be used with the scrap submergence device of U.S. Pat. No. 6,217,823, herein incorporated by reference. Of course, use of the present dryer assembly is not limited to use with the Pyrotek LOTUSS system.

Figure 6:
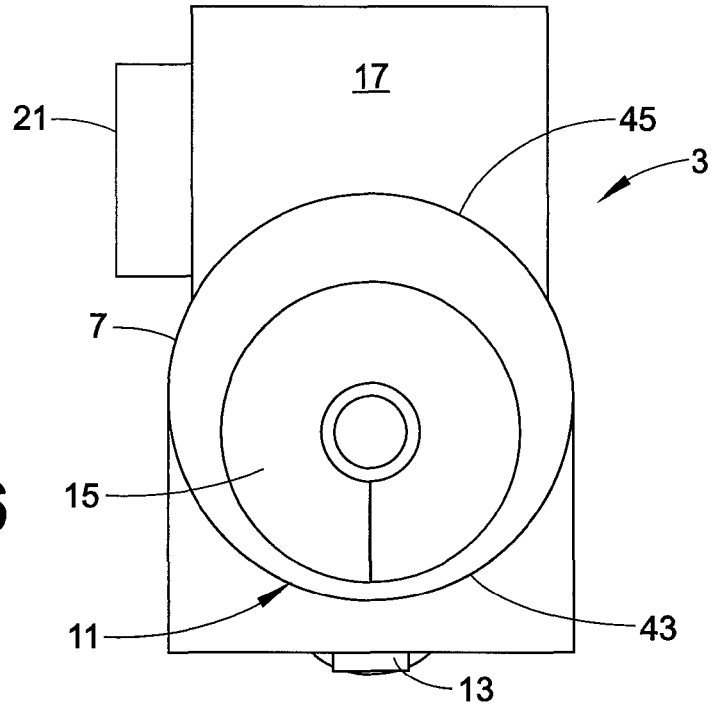
FIG. 6 is an end view of the top portion of the device of FIGS. 2-5.

With reference to FIG. 6, the orientation of the upper unit 3 is depicted showing the upper unit outlet 11 and demonstrating the preferred asymmetrical relationship between the conveyor screw 15 and the elongated tube 7. In certain designs it may be advantageous for the conveyor screw to be oriented closer to a bottom surface 43 of the tube 7 than to a top surface 45. The screw conveyor speed can be easily adjusted for proper residence time to achieve optimal drying and high energy efficiency.

Figure 4A:
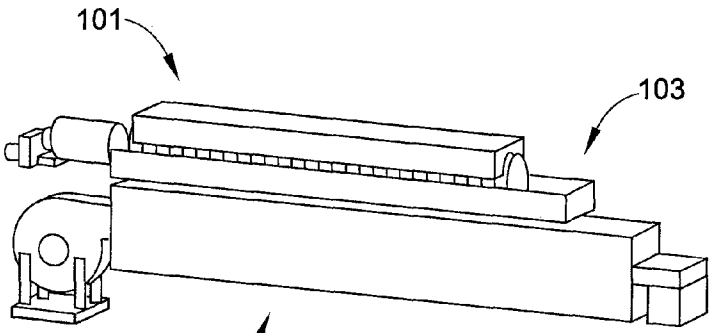
FIG. 4 is a perspective view (partially in phantom) of an alternative chip dryer embodiment.
Figure 4B:
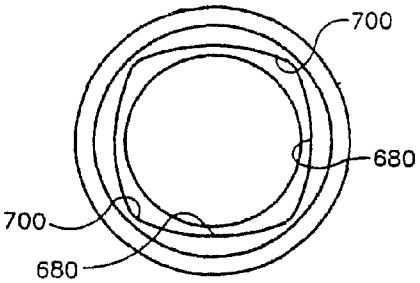
Figure 5:
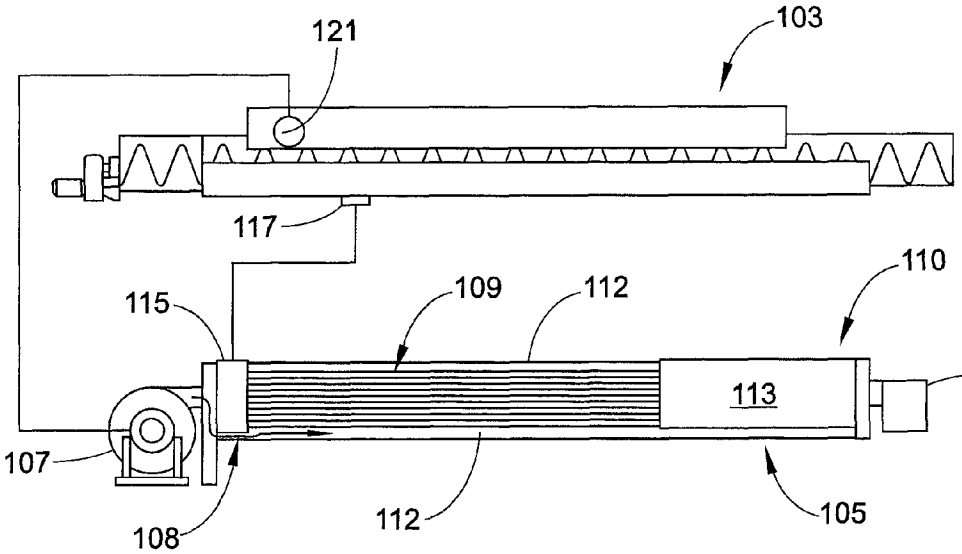
FIG. 5 is a side elevation view, partially in cross section, of the chip dryer of FIG. 4.

With reference now to FIGS. 4 and 5, a closed loop dryer configuration 101 is provided. This embodiment is beneficial because recuperative heat flow may save 40% or more in energy usage. In the closed loop configuration 101, the upper unit 103 is generally configured the same as in the open loop configuration described above. Lower unit 105, however, is configured differently. Dryer exhaust gas is fed from outlet 121 in the upper unit 103 to a blower 107. Exhaust gas is passed from the blower 107 into a first end 108 of a heat exchanger 109 and travels to a remote end 110 of the lower unit 105. In addition to passing through the heat exchanger 109, the exhaust gas is preferably passed through plenum 112 forming an exterior surface of the lower unit 105 such that an outer surface of the lower unit 105 is at a relatively low temperature. Remote end 110 includes a heater 111 which increases the temperature in a VOC elimination chamber 113 to an elevated temperature such as 1400° F. or higher. Super-heated air is then transferred from the VOC elimination chamber 113 to an opposed side of the heat exchanger 109 from the exhaust gas whereby the temperature of the exhaust gas is increased as it approaches the VOC elimination chamber 113 and the temperature of the super-heated gas is reduced prior to its reintroduction into the upper unit 103 via outlet 115 and inlet 117.

With reference to FIG. 4B, the use of a quadralobal drive-conveyor screw shaft connection is illustrated. The connection can include four concave sidewall portions 680 and four rounded corners 700 that connect the sidewall portions. Moreover, while the end of the shaft adjacent the discharge end of the of the upper unit 103 can be pinned to a rotational support mechanism, the drive end can have a shape suited for mating with a coupling that allows for both radial and axial thermal expansion. Moreover, a gap can be provided between the longitudinal end of the shaft and the closed end of the coupling. Similarly, the quadralobal coupling provides expansion regions radially at the point of engagement with the shaft. As one example the coupling and shafting mating assembly described in U.S. Pat. No. 5,634,770, herein incorporated by reference.

Figure 8:
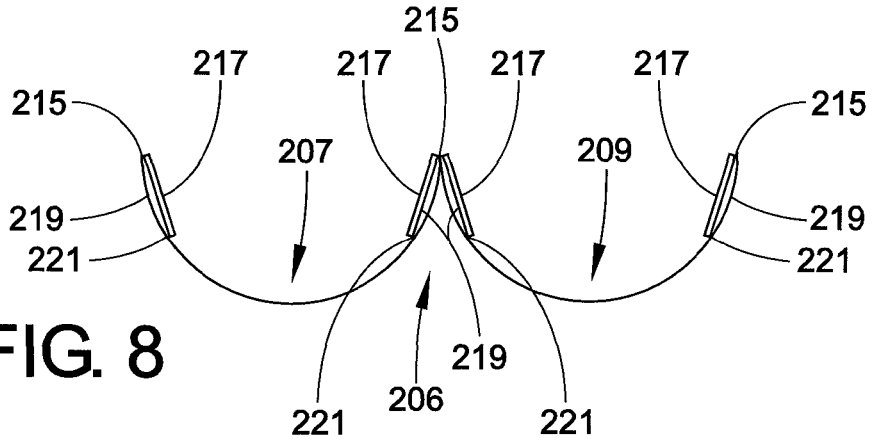
FIG. 8 is an end view of the jet feed tray of FIG. 7.
Figure 9:
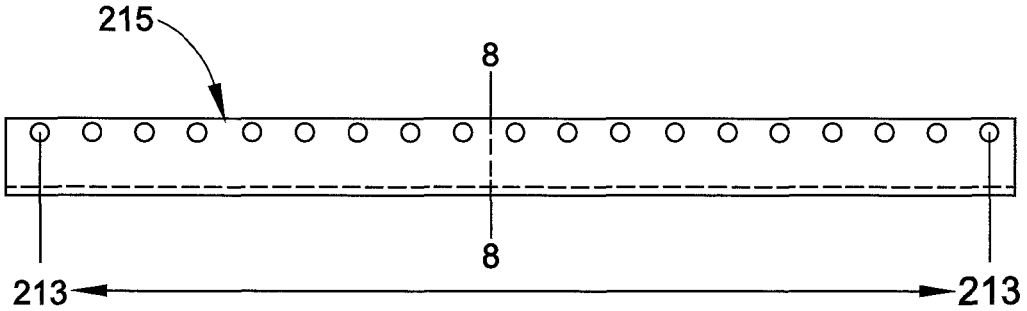
FIG. 9 is a side plan view of the jet feed tray of FIG. 8.
Figure 7:
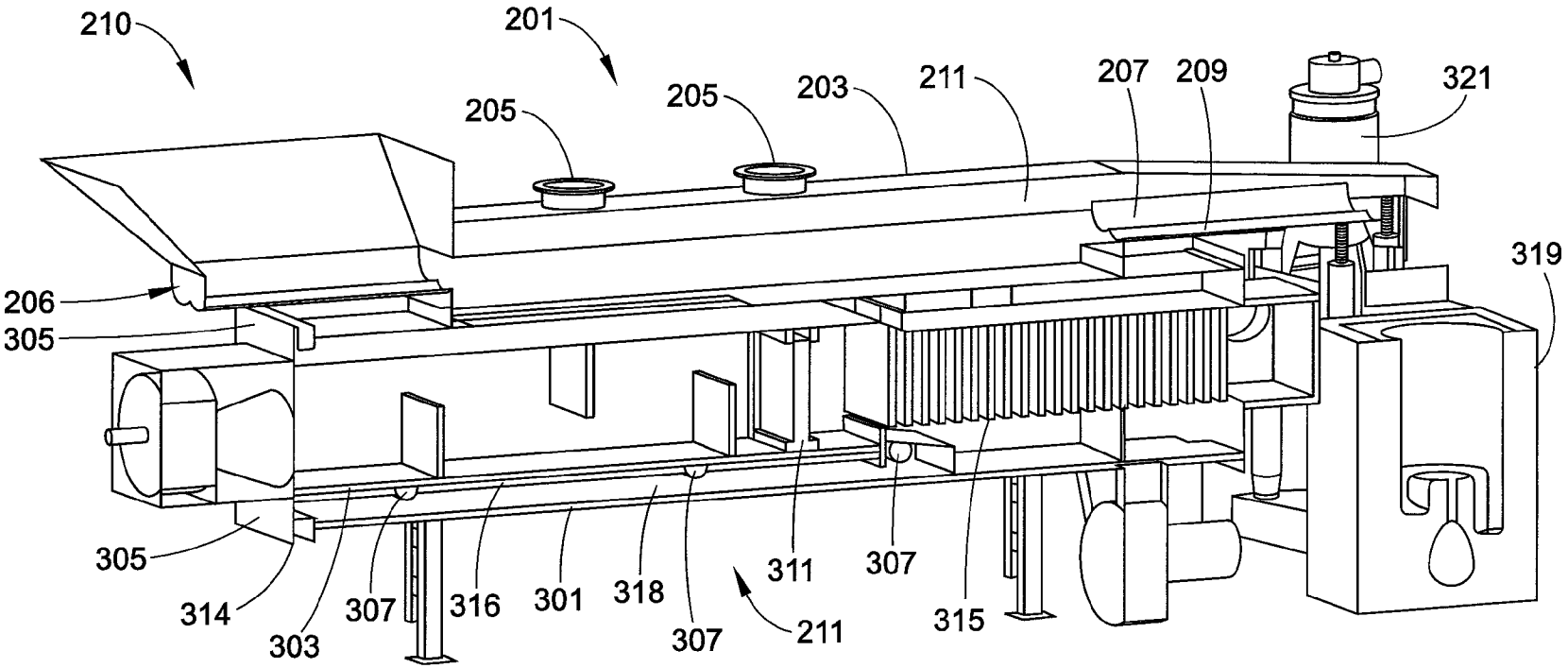
FIG. 7 is a perspective view, partially in cross-section of a further alternative embodiment of the chip dryer.

Referring now to FIGS. 7-9, an alternative embodiment chip dryer 201 is depicted. In the depicted embodiment, an alternative version of an upper unit 203 is illustrated. In this embodiment, a plurality of exhaust outlets 205 are provided. Furthermore, the chip feeding elongated tube 206 is comprised of a pair of semi-circular troughs 207 and 209. Elongated tube 206 receives scrap chips via inlet 210.

With specific reference to FIGS. 8 and 9, it is noted that hot air (see arrows FIG. 8) from lower unit 211 enters the troughs 207 and 209 via a plurality of passages 213 along edges 215. A flat plate 217 (an air knife) is either bent or welded adjacent to the edges 215. The region of plate 217 opposite the edges 215 can include a gap relative to the respective trough 207 and 209. In this manner, a channel 219 is formed between each respective plate 217 and its associated trough 207 or 209 with a jet passage 221 formed opposite the attachment point at the edge 215. Accordingly, hot air delivered by the lower unit 211 air is channeled into the respective channels 219 exiting through a gap 221 for high velocity delivery to the scrap feed. In this manner, an increased velocity flow of high temperature air is provided into the passing scrap feed. In certain embodiments, the point of intersection between upper edge 215 and the plate 217 can be completely sealed. The jet passage 221 can be continuous or may be intermittently interrupted by a spot weld, for example.

Returning now with specific reference to FIG. 7, it is noted that the lower unit 211 may include a housing exterior 301 and an internal high temperature VOC elimination chamber body 303 which may on occasion need cleaning. Accordingly, internal VOC elimination chamber body 303 can be secured to the exterior housing 301 via cooperative mating elements including screws or bolts 305. VOC elimination chamber body 303 can also be equipped with a plurality of wheels 307 interactive with housing 301 such that upon removal of the screws 305, VOC elimination chamber body 303 can be slidingly removed from exterior housing 301. This can facilitate the cleaning of the VOC elimination chamber 313.

An expansion joint 314 can be included to accommodate the differences in thermal expansion between the exterior housing 301 and the internal high temperature VOC elimination chamber body 303. In addition, it is noted that it may be desirable to provide an insulation layer 316 surrounding the high temperature VOC elimination chamber body 303 to prevent overheating of air residing in the plenum 318.

It is also noted that the embodiment of FIG. 7 has been equipped with a filter element 311 (such as a ceramic foam filter) disposed within the VOC elimination chamber 313. In this manner, the contaminants contained within the heated air of the VOC elimination chamber 313 may be prevented from entering the remainder of the system such as heat exchanger 315 or the upper scrap treatment chamber 211.

FIG. 7 also provides an illustration of the association of the chip dryer 201 with scrap submergence chamber 319 which is shown in association with a molten metal pump 321. These components would reside in or otherwise be associated with a furnace charge well and/or pump well as is known to the skilled artisan.

Figure 10:
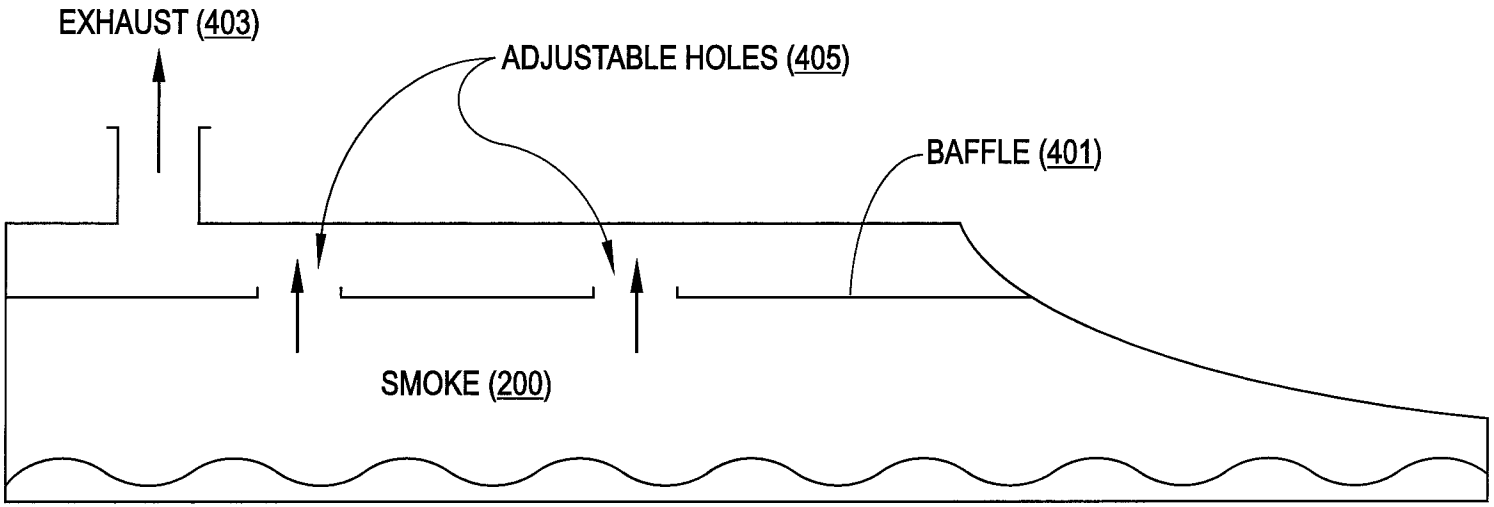
FIG. 10 is a schematic illustration of an adjustable exhaust zone.

Turning now to FIG. 10, an additional aspect of the present disclosure is provided. An adjustable baffle 401 may be included in the scrap treatment chamber 211. Particularly, the adjustable baffle 401 can be located in the upper unit 203 and surround the exhaust outlet 403. A sliding mechanism 405 or other mechanism known to the skilled artisan can be provided within adjustable baffle 401 to provide control of the size of passage holes 405 to further control the rate of heated air transfer from the treatment chamber 211 into the exhaust outlet 403.

Figure 11:
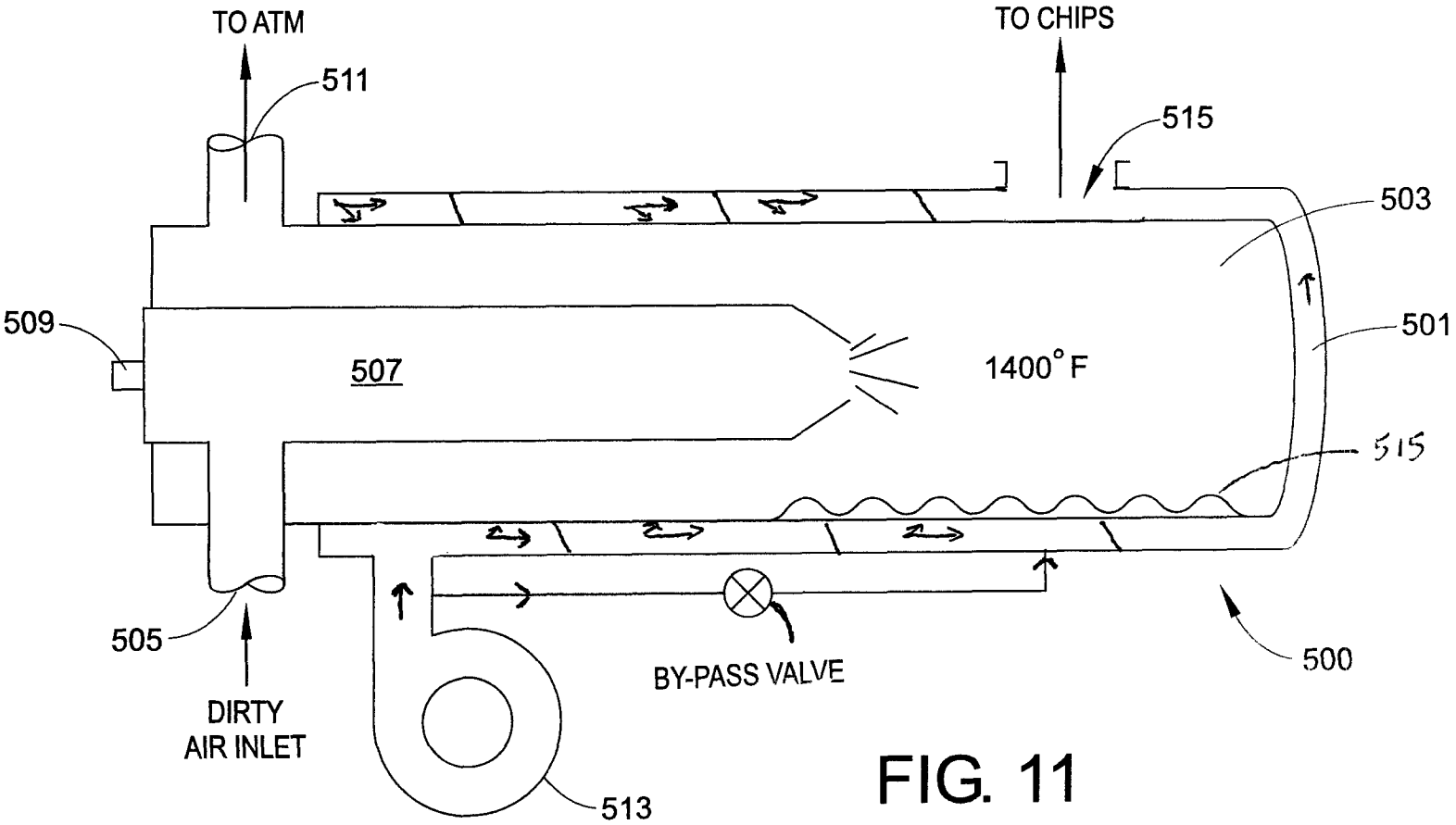
FIG. 11 is a side elevation view in cross-section of a further alternative embodiment of the chip dryer.

Referring now to FIG. 11, an alternative burner system 500 is depicted. In this embodiment, the heat exchanger constitutes a plenum chamber 501 surrounding a high temperature chamber 503. VOC inclusive air is introduced to system 500 via inlet 505 to burner chamber 507 where it is acted upon by burner 509. Treated air is circulated within chamber 503 rearwardly for discharge to the atmosphere via outlet 511. Air forced by fan 513 into plenum 501 is circulated around chamber 503 and heated to the desired temperature for introduction into the chips via passage 515. Plenum 501 may be in the form of a spiral passage encircling chamber 503 to increase residence time. Furthermore, the outer surface of chamber 503 may be formed of a corrugated, or other roughened surface 515, to increase surface area exposure for air within plenum 501.

In this regard, it is noted that the overall system is a contained unit which by properly controlling and integrating the various adjustable features thereof, a desirable chip temperature and air flow speed can be controlled. More particularly, it is noted that by integrating control of the exhaust fan, the process fan, the gas supply and/or the baffle element, the system becomes highly controllable. To maintain an idealized chip temperature of, for example, 800° F., the system, is adjustable by varying the fan speed, the exhaust feed and the burner output.

Moreover, by varying the operational rate of the heater and the speed of gas flow within the device, the temperature within the VOC elimination chamber can be controlled. Similarly, it is desirable to maintain a gas flow which is between slightly negative and neutral. This can be achieved by properly balancing the dryer exhaust fan operation speed, the fresh air intake fan (if present) operation speed, and the outlet baffles.

In this regard, it may be desirable to provide a 3 PID loop control with associated monitoring of temperature in various locations of the chip dryer. For example, if the chip temperature is gauged to be too low, the operational rate of the heater may be automatically increased, and/or the baffles may be somewhat closed to provide greater residence time for a higher temperature gas. Similarly, it is envisioned that the baffle and the fan(s) can be linked to provide suitable pressure variations within the system and provide an efficient rate of gas circulation.

Lastly, it is noted that the system is also amenable to the utilization of waste heat from other locations of the plant environment as a source of elevated temperature gas into the chip dryer.

In operation, wet chips are metered into the dryer where they are conveyed via screw conveyor; the chips can be dried to 0.1% or lower moisture contact. The exhaust air from the drying process is drawn into the heat exchanger where it is preheated to 800 F then into the burner equipped oxidizer where VOCs are eliminated. The air is then cooled down as it is passed back across the heat exchanger and returned to the chips for drying. Excess clean air exhaust can be tapped off from the oxidizer to atmosphere.

The present dryer is advantageous because it reduces organic contact in the scrap material to 0.1% or less. This is significant because contamination induced melt loss is typically 1% organics=2% melt loss.

As seen on the table below, a large variation in processing conditions exist in the industry. The dryer was evaluated with a variety of scrap types encountered in the real world and demonstrated an excellent ability to achieve low cost reduction in contamination of scrap.

Sample Testing:

Jet Dryer Testing
043013rev0
48" 6" Screw in 8" Diameter Unit
1740 Jet holes at 0.95" diameter in 8" lower diameter
¼ scale of 1000 lbs./hr. unit
Air flow set up at 300 SCFM maximum

| Test # | 1 | 2 | 3 | 4 |
|---|---|---|---|---|
| Test wt. (lbs.) | 600 | 600 | 300 | 700 |
| Chip type | Test Standard wheel chips | Test standard wheel chips | Aisin Automotive | Albany Die Cast |
| Chip moisture at inlet (%) | 5 | 5 | 23 | 12 |
| Chip bulk density (lbs/ft3) | 44 | 44 | 25 | 22 |
| Screw speed (HZ) | 10 | 15 | 10 | 10 |
| Fluid % oil | 5% | 5% | est. 5% | est. 5% |
| Process air (F.) | 800 | 800 | 825 | 900 |
| Oxidizer temperature (F.) | 1200 | 1200 | 1150 | 1200 |
| Preheat air temperature | 900-700 | 900-700 | 900-700 | 1000 |
| Inlet Air to HX (F.) | 300 | 300 | 268 | 300 |
| Air flow DP pitiot tube ("wg) | 0.1 | 0.1 | 0.14 | 0.8 |
| Air flow (ACFM) | 300 | 300 | 360 | 240 |
| 0.2% | ~8% | ~8% | ~8% | ~8% |
| Final chip temp est. | 650 | 600 | 750 | 780 |
| Recirculation fan (Hz) | 30 | 30 | 25 | 20 |
| Moisture at exit sample 1 | 0.05% | 0.20% | 0.01% | 0.01% |
| Rate (lvs./hr.) | 300 | 450 | 200 | 200 |
| Visual melt test (melting in molten metal bath vortex) | No flames/ smoke | No flame/ light smoke | No flame/ smoke | No flame/ smoke |

The dryer of this disclosure is advantageous because it treats the contamination in the scrap during the drying process in the integrated thermal oxidizer with an energy efficiency of between about 600 and 800 BTU/lb or less. This device is simple and easy to install allowing foundry operations to process their own material instead of shipping to a secondary processor. Use of the present heat exchanger system also allows for high velocity air flow to the chips for optimized forced convection. A further benefit of the design is the use of relatively cool air to surround the thermal oxidizer resulting in a system that only requires light insulation (vs. 8-12" on conventional oxidizer). In addition, in the closed-loop embodiment of FIG. 5, the present dryer runs at about an 8% or less oxygen level which allows for good contamination removal but prevents the treated aluminum scrap from oxidizing.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A dryer for removing hydrocarbons and/or moisture from metal chips, the dryer comprising a top portion and a base portion, the top portion comprised of an elongated chamber containing a scrap conveyor; the base portion comprising a burner, a heat exchanger and a high temperature VOC elimination chamber, said dryer configured to receive the metal chips at an inlet and transport the metal chips to an outlet while receiving heated air from the base portion.

2. The dryer of claim 1 wherein the base portion includes a port receiving external air.

3. The dryer of claim 1 wherein the scrap conveyor comprises a screw conveyor.

4. The dryer of claim 2 wherein said external air is introduced into a plenum forming an outer region of a lower unit.

5. A dryer for removing at least one of hydrocarbons and moisture from metal chips, the dryer including a top portion and base portion, the top portion comprising an elongated chamber having an inlet end and an outlet end and a screw conveyor extending between the inlet end and the outlet end, the base portion comprising an inlet portion comprising an inlet for top portion exhaust gas, a plenum for transporting said top portion exhaust gas adjacent to an external surface of a lower unit, a heater for increasing temperature of the exhaust gas to obtain super-heated exhaust gas and remove VOCs, a heat exchanger for receiving said super-heated exhaust gas and transferring heat to the top portion exhaust gas.

6. The dryer of claim 5 wherein said dryer comprises a closed loop system.

7. A dryer for removing hydrocarbons and/or moisture from metal chips, the dryer comprising a top portion and a base portion, the top portion comprised of an elongated tubular chamber containing a scrap conveyor; the base portion comprising a burner, a heat exchanger and a high temperature VOC elimination chamber, wherein exhaust gas from said top portion is received in said base portion and heated by said burner within said VOC elimination chamber to obtain a super-heated gas, said super-heated gas being introduced to a first side of said heat exchanger and external air being introduced to a second side of said heat exchanger to provide heated external air, said dryer configured to receive the metal chips at an inlet and transport the metal chips to an outlet while receiving heated external air from the base portion.

8. The dryer of claim 1 wherein said scrap conveyor is disposed asymmetrically within said chamber.

9. The dryer of claim 8 wherein said scrap conveyor is oriented closer to a bottom surface of said chamber than a top surface.

10. The dryer of claim 1 wherein the scrap conveyor includes an elongated cylindrical trough including a plurality of jet passages receiving the heated external air.

11. The dryer of claim 10 including at least two troughs.

12. The dryer of claim 10 wherein an air knife is disposed adjacent each jet passage.

13. The dryer of claim 1 wherein a by-pass is provided intermediate a fan introducing air to the second side of the heat exchanger.

14. The dryer of claim 3 wherein the screw conveyor includes a quadralobal interconnection with a drive coupling.

15. The dryer of claim 1 further including a cyclone dust collector.

16. The dryer of claim 15 wherein said cyclone dust collector includes a filter.

17. The dryer of claim 1 wherein a waste heat is received.

18. The dryer of claim 1 further including a ceramic foam filter.

19. The dryer of claim 1 wherein said burner and heat exchanger are mounted on rollers and slidably removable from a lower unit.

20. The dryer of claim 1 further comprising an expansion joint between a housing and VOC elimination chamber.

21. A method of recycling metal scrap including drying of scrap within the dryer of claim 1.

* * * * *